US005567121A

United States Patent [19]

Peterson

[11] Patent Number: 5,567,121

[45] Date of Patent: Oct. 22, 1996

[54] INDICATOR-PORTED DISCHARGE VALVES FOR RECIPROCATING COMPRESSORS

[76] Inventor: William C. Peterson, 301 Park Dr., Severna Park, Md. 21146-4415

[21] Appl. No.: 376,234

[22] Filed: Jan. 23, 1995

[51] Int. Cl.[6] ..... F04B 39/10

[52] U.S. Cl. ..... 417/63; 417/440; 417/442; 137/557

[58] Field of Search ..... 417/63, 297, 454, 417/238, 434, 435, 442, 504; 137/557, 854, 856

[56] References Cited

U.S. PATENT DOCUMENTS

| | | | |
|---|---|---|---|
| 1,649,530 | 11/1927 | Holsinger | 417/63 |
| 2,547,377 | 4/1951 | De Juhasz | 137/854 |
| 3,651,827 | 3/1972 | Hammer et al. | 137/557 |
| 4,081,171 | 3/1978 | Morgan et al. | 137/549 |
| 4,456,963 | 6/1984 | Wiggins . | |
| 4,740,140 | 4/1988 | Benson | 137/557 |

FOREIGN PATENT DOCUMENTS

| | | | |
|---|---|---|---|
| 164866 | 7/1954 | Australia | 417/63 |
| 19242 | 2/1979 | Japan | 137/557 |

*Primary Examiner*—Timothy Thorpe
*Assistant Examiner*—Roland G. McAndrews, Jr.
*Attorney, Agent, or Firm*—William L. Krayer

[57] ABSTRACT

A compressor cylinder discharge valve is adapted for monitoring of internal pressure and performance by tapping through the center bolt thereof to obtain pressure values.

10 Claims, 1 Drawing Sheet

INDICATOR-PORTED DISCHARGE VALVES FOR RECIPROCATING COMPRESSORS

TECHNICAL FIELD

This invention relates to the field of stationary compressors as used in power plants, refineries, pipeline compression of natural gas, and other installations where gasses are compressed for industrial purposes, and particularly to the in-service monitoring and analysis, such as electronic analysis, of the condition and performance of such compressors. The invention is specifically addressed to the adaptation of compressors which were not provided with indicator ports at the time of manufacture, and, as a result, cannot adequately be analyzed at the present time.

BACKGROUND OF THE INVENTION

An industrial reciprocating gas compressor is a positive-displacement machine wherein the gas to be compressed is trapped in an enclosed space and then squeezed into a small volume by the action of a piston moving inside a cylinder. The gas is compressed to a pressure sufficient to overcome the discharge pressure plus the spring tension holding the discharge valve closed, at which time the discharge valve opens and allows the compressed gas to leave the cylinder. Because of the nature of the reciprocating piston, compression ceases at the limits of its stroke, the discharge valve again closes due to the action of the springs on the valve, the piston reverses direction, and the small amount of gas remaining in the cylinder expands, increasing in volume and decreasing in pressure, until the inlet pressure is higher than the pressure inside the cylinder plus the spring tension holding the inlet valves closed. The inlet valves then open, allowing gas to flow into the cylinder. At the opposite limit of the piston stroke, the inlet valve also closed due to the action of the springs acting on the valves, the piston again reverses direction, and the compression cycle begins anew.

The rate of pressure rise with respect to piston position in the cylinder, the exact moment of valve actuation, actual pressures attained, and other information concerning the compression, discharge, re-expansion, and inlet events taking place in the cylinder have long been recognized to be of value to engineers in assessing the operating condition of compressors. The first instrument used to record such information was a mechanical device which comprised a stylus attached to a pressure indicator and a rotating drum which was activated in proportion to the movement of the piston by a string attached to the crosshead of the compressor. The instrument was attached to the cylinder with a three-way valve, and sensed pressures inside the cylinder via passages (indicator ports) drilled during manufacture of the compressor. Compressor speeds were limited to 300 rpm or less.

The state of the analyzing art advanced during the 1960s with the introduction of the BETA 100, an oscilloscope device that utilized pressure transducers to sense pressure through the indicator ports, and determined piston location from the angle of the crankshaft of the compressor. Further refinements of such electronic analyzers have been based on the principles of the early devices, and now include displays of pressure/volume or pressure/time, automatic calculation of horsepower consumed by the cylinder, and volumetric efficiency of the cylinder, as well as analysis of each valve event. Data from displacement transducers (for determining compressor rod 'run-out'), vibration transducers, and ultrasound detectors (for analyzing the behavior of individual valves) are routinely superimposed on the pressure-volume trace to pinpoint operational problems and to determine the need for maintenance. Data from the analyzer may be sent to a personal computer for the automatic generation of reports.

Significant savings in operational expenses and maintenance costs are attainable if the information is analyzed at routine intervals. There was a gap between the use of the drum-and-stylus instruments and the modern electronic instruments, however, and manufacturers stopped providing indicator ports in cylinders during the 1960s, 1970s and early 1980s and usually did not list indicator ports as an option when ordering a new machine. As a result, many compressors currently in operation do not have indicator ports and therefore cannot be analyzed properly.

Detailed description of a more or less contemporary monitoring system for reciprocating piston machines, including the use of pressure transducers, is given by Wiggins in U.S. Pat. No. 4,456,963. Other references to the use of pressure monitoring are given by Rice in U.S. Pat. No. 4,111,041 and Abnett et al in U.S. Pat. No. 4,325,128. However, I am not aware of a reference in which the pressure transducers are able to sense the cylinder pressure through the center bolt or other center port of a valve such as a discharge valve, as I do.

Installation of indicator ports after manufacture conventionally involves complete disassembly of the compressor and tedious machine shop work to locate and drill the ports. The compressor must remain out of service for extended periods of time with lost production costs accumulating. Often, the cylinder casting does not have provisions for adding an indicator port, and installing one entails penetration and sealing the water jacket surrounding the cylinder. Many times, cylinder liners do not have indicator ports or the indicator ports in the cylinder liners do not align with indicator ports in the cylinder. Without indicator ports, much of the intelligence necessary for analysis is lost. There is clearly a need for a simple and effective way to equip compressors with indicator ports for monitoring compressor cylinder condition and performance.

SUMMARY OF THE INVENTION

This invention is a new valve design which incorporates an indicator port directly through the valve center bolt, that can be installed in a compressor cylinder without disassembly and machining the cylinder. Conventional poppet, concentric-ring, or dampened-disk valves are typically assembled from parts held together by a small-diameter bolt at the center. The bolt retains the valve parts until the valve is installed in the valve port. The valve is held in place by the valve chair. The jack bolt, threaded through the center of the valve cover, bears on the valve chair which, in turn, bears on the valve to provide the needed clamping force on a gasket between the valve and the cylinder. Additional clamping force is provided by valve cover bolts around the periphery of the valve. The present invention differs from this conventional arrangement in that larger-diameter mechanical tubing with one end threaded is substituted for the bolt. The mechanical tubing extends through a hole drilled in the valve chair, and also extends out of the gas passage through a hollow jack bolt at the center of the valve cover. The annular space between the outside diameter of the tubing and the inside diameter of the hollow jack bolt is sealed by two elastomeric O-rings, which effectively seal the gap, but allow for rotational movement during assembly. The outer end of the mechanical tubing is capped with a pipe-threaded ball valve that will accept a connector such as a Kiene adapter for the pressure transducers normally used with electronic analyzers. The ball valve is normally closed and plugged when the pressure transducer is not attached.

DETAILED DESCRIPTION OF THE INVENTION

Figure 1:
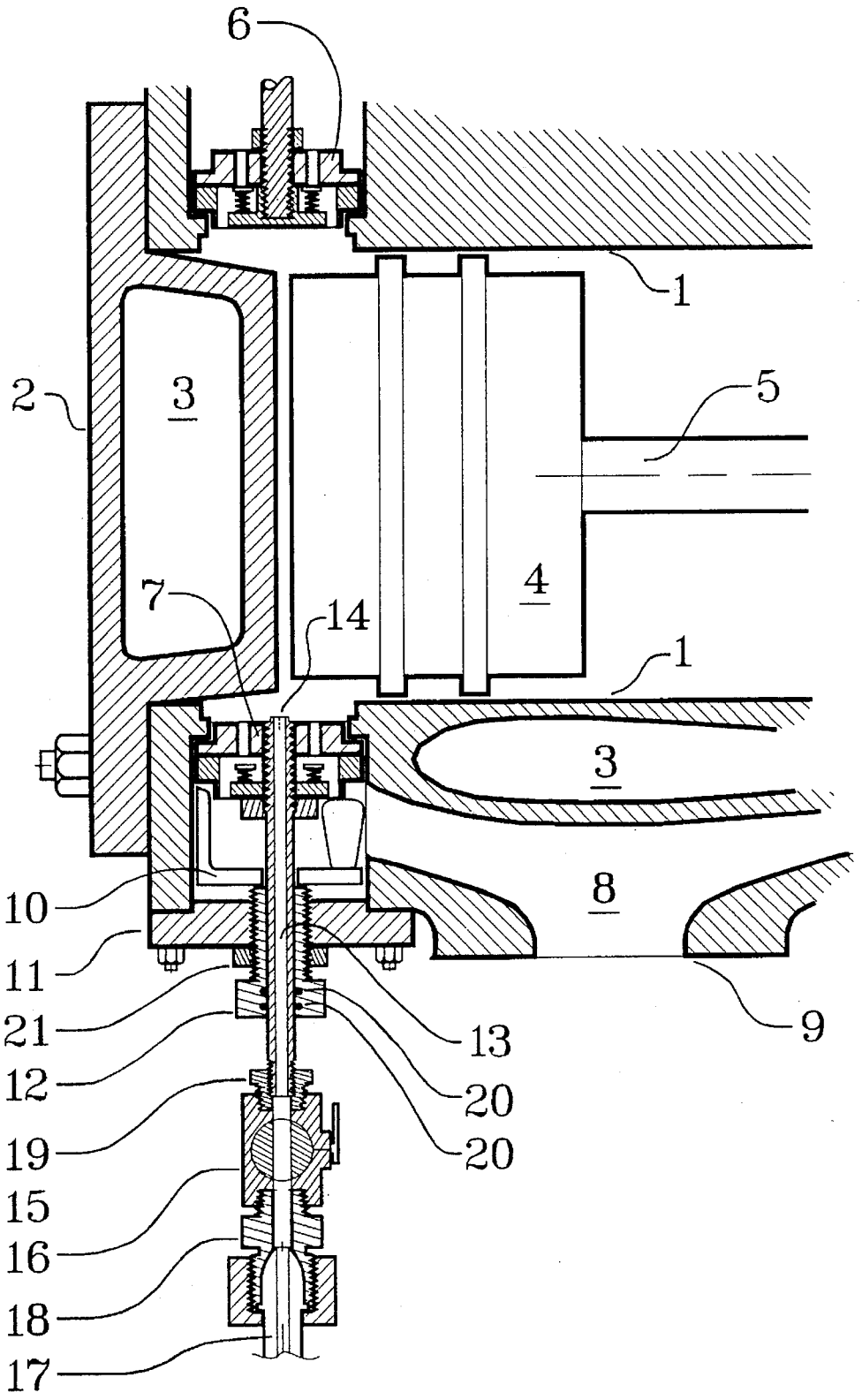
FIG. 1 is a sectional view of a typical arrangement for my invention with respect particularly to a concentric ring type of construction for a discharge valve, shown with its associated cylinder.

In FIG. 1, a cylinder 1 including cylinder head 2 may define a water jacket 3. The piston 4 is connected to piston rod 5 as is known in the art. The cylinder also conventionally is equipped with suction valve 6 and discharge valve body 7 conventionally connected to air passage 8 through discharge flange 9.

As contemplated in the present invention, the discharge valve body 7 contacts valve chair 10 and valve cover 11, both adapted to receive, as a valve stem, a hollow jack bolt 12 which in turn traverses indicator port tube 13 through its length to discharge valve body 7, terminating in an opening 14 in the interior of cylinder 1. The exterior terminus 15 of the indicator port tube 13 is exterior of hollow jack bolt 12.

Exterior terminus 15 of indicator port tube 13 is connected to a valve such as ball valve 16 adapted to permit connection to a pressure transducer 17 through a connector such as the preferred Kiene adaptor 18.

The parts recited above may be assembled through a pipe-threaded bushing 19, and O-rings 20 which form a seal between the hollow jack bolt 12 and the indicator port tube 13.

Persons skilled in the art will see that my design permits monitoring of the condition of a compressor cylinder by measuring pressures read through the indicator port tube 13 which passes from its terminal opening 14 through the discharge valve to the ball valve 16; the pressure is sensed in a known manner through Kiene adaptor 18 and converted to an electronic or other analog or digital signal by transducer 17. Persons skilled in the art will also recognize that my design can be readily installed in the field in compressors in commercial use. In either case, as original equipment or installed in the field, my invention will not interfere with or affect the operation of any other compressor cylinder component.

As indicated in the Background of the Invention, many compressors in commercial use are quite similar to that illustrated in FIG. 1 except that the hollow jack bolt 12 and the indicator port tube 13 are replaced by a simple bolt, and of course the ball valve 16, Kiene adaptor 18, and pressure transducer 17 are not present. To install my invention, one need only remove the solid bolt present through valve 7 and replace it with a jack bolt 12 having an indicator port tube 13, and attach a pressure sensing device to the tube. This can be done in a very short time and certainly can be accomplished during normally scheduled maintenance without the need to dismantle the compressor cylinder for machining.

While it is conceivable that the pressure could be converted directly to a pneumatic or other analog or digital signal as is known in the art, I prefer to use the sequence shown, in which the transducer 17 can be removed during periods when monitoring is not needed or desired, and the ball valve 16 will then seal to permit continiuous normal working of the discharge valve. The transducer will normally convert the sensed pressure to an electrical signal as is known in the art, or, if desired, to a pneumatic or other signal. Any device which performs the functions of the ball valve and transducer may be substituted for them.

As is also known in the art, the Kiene adaptor operates to connect the ball valve 16 and the pressure transducer 17. Any device which performs a similar function may be substituted in my invention.

Thus it will be seen that my invention is a valve for a compressor cylinder comprising a valve body and a hollow center bolt, preferably extended, having a passage through said body adapted to open in the interior of a cylinder and terminate externally of said hollow center bolt. Another summary of my invention is that it is a discharge valve for a compressor cylinder, said discharge valve including a hollow jack bolt stem, an indicator port tube therethrough opening in the cylinder side of said valve, and a pressure transducer attached to said indicator port tube and adapted to sense the pressure therein and generate a control or other signal as a function of the pressure in the cylinder.

I claim:

1. A valve for a compressor cylinder comprising a valve body and a valve center bolt, said valve center bolt defining a passage through said valve body, said passage adapted to open to the interior of said compressor cylinder and having an exterior terminus at the exterior of said valve center bolt.

2. The valve of claim 1 including a pressure transducer for sensing pressure at said exterior terminus of said valve passage.

3. A valve of claim 1 including a discharge flange, said valve being a discharge valve.

4. A valve of claim 1 including transducer means for generating a signal as a function of pressure at said exterior terminus, and means for connecting said transducer means to said exterior terminus.

5. A compressor cylinder comprising a cylinder, a piston, an inlet valve and a discharge valve, said discharge valve comprising a valve body and a valve center bolt, said valve body and valve center bolt defining an indicator port opening in the interior of said cylinder and terminating exterior of said discharge valve.

6. A compressor cylinder of claim 5 including means connected to said exterior terminus of said indicator port for generating a signal as a function of pressure in said indicator port.

7. A compressor cylinder of claim 5 wherein said indicator port comprises a tube.

8. A compressor cylinder of claim 6 wherein said means for generating a signal are connected to said exterior terminus through a ball valve.

9. A discharge valve for a compressor cylinder comprising a valve body, a hollow jack bolt passing therethrough, a tube passing through said hollow jack bolt and having an opening exterior of said valve, a ball valve connected to said exterior opening of said tube, and a Kiene adaptor attached to said ball valve.

10. The discharge valve of claim 9 including a pressure transducer attached to said Kiene adaptor.

* * * * *